US010070210B2

(12) United States Patent
Battyanyi

(10) Patent No.: US 10,070,210 B2
(45) Date of Patent: Sep. 4, 2018

(54) SPEAKER ASSEMBLY AND INTEGRATED LIGHT

(71) Applicant: CAMEC PTY LTD, Dandenong South, Victoria (AU)

(72) Inventor: Les Battyanyi, Dandenong South (AU)

(73) Assignee: CAMEC PTY LTD, Dandenong South, Victoria (AU)

( * ) Notice: Subject to any disclaimer, the term of this patent is extended or adjusted under 35 U.S.C. 154(b) by 0 days.

(21) Appl. No.: 15/038,233

(22) PCT Filed: Nov. 24, 2014

(86) PCT No.: PCT/AU2014/050370
§ 371 (c)(1),
(2) Date: May 20, 2016

(87) PCT Pub. No.: WO2015/074122
PCT Pub. Date: May 28, 2015

(65) Prior Publication Data

US 2016/0295308 A1 Oct. 6, 2016

(30) Foreign Application Priority Data

Nov. 22, 2013 (AU) ..... 2013904518

(51) Int. Cl.

| | |
|---|---|
| ***H04R 1/02*** | (2006.01) |
| ***H04R 1/24*** | (2006.01) |
| ***H04R 1/26*** | (2006.01) |
| ***H04R 1/44*** | (2006.01) |
| ***F21V 31/00*** | (2006.01) |

(Continued)

(52) U.S. Cl.
CPC ..... *H04R 1/02* (2013.01); *F21V 31/00* (2013.01); *F21V 33/0056* (2013.01); *H04R 1/028* (2013.01); *H04R 1/26* (2013.01); *H04R 1/44* (2013.01); *F21Y 2101/02* (2013.01); *F21Y 2103/022* (2013.01); *F21Y 2105/10* (2016.08); *F21Y 2115/10* (2016.08); *H04R 1/24* (2013.01); *H04R 2499/13* (2013.01)

(58) Field of Classification Search
CPC . H04R 1/02; H04R 1/028; H04R 1/26; H04R 1/24; H04R 2499/13; F21V 31/00; F21V 33/056; F21V 3/056; F21Y 2115/10; F21Y 2101/02; F21Y 2103/022
See application file for complete search history.

(56) References Cited

U.S. PATENT DOCUMENTS 5,181,253 A * 1/1993 Jordan ..... H04R 9/06 381/182
5,918,972 A * 7/1999 Van Belle ..... B60H 1/262 362/149

(Continued)

FOREIGN PATENT DOCUMENTS

CN 203099585 U 7/2013

*Primary Examiner* — Sonia Gay
(74) *Attorney, Agent, or Firm* — King & Schickli, PLLC

(57) ABSTRACT

A speaker assembly and integrated light, comprising: a speaker having at least one sound emitting element; and, at least one array of LEDs mounted on the speaker. In some arrangements, the speaker may be wirelessly connected to an audio source. The invention has many potential applications and is particularly suitable for recreational vehicles (sometimes referred to as RVs) and/or outdoor use.

19 Claims, 4 Drawing Sheets

(51) Int. Cl.

| | |
|---|---|
| ***F21Y 115/00*** | (2016.01) |
| ***F21V 33/00*** | (2006.01) |
| *F21Y 105/10* | (2016.01) |
| *F21Y 115/10* | (2016.01) |
| *F21Y 101/02* | (2006.01) |
| *F21Y 103/02* | (2006.01) |

(56) References Cited

U.S. PATENT DOCUMENTS

| | | | | |
|---|---|---|---|---|
| 7,784,957 | B2 | 8/2010 | Wright | |
| 8,059,830 | B1 * | 11/2011 | Gleason | H04R 5/04 381/86 |
| 8,666,104 | B2 | 3/2014 | Ivey et al. | |
| 9,469,254 | B1 * | 10/2016 | White | H04R 1/403 |
| 2004/0047478 | A1 * | 3/2004 | Combest | H04R 1/24 381/182 |
| 2004/0175014 | A1 * | 9/2004 | Liu | H04R 1/028 381/386 |
| 2005/0237218 | A1 * | 10/2005 | Tang | H04R 5/02 340/815.45 |
| 2008/0298045 | A1 * | 12/2008 | Wright | F21V 33/0056 362/86 |
| 2011/0317861 | A1 | 12/2011 | Haase | |
| 2013/0016864 | A1 | 1/2013 | Ivey et al. | |

* cited by examiner

SPEAKER ASSEMBLY AND INTEGRATED LIGHT

FIELD

The invention relates to a speaker assembly and integrated light. In a particular aspect, the invention relates to a combination speaker and LED light. The invention has many potential applications and is particularly suitable for recreational vehicles (sometimes referred to as RVs) and/or outdoor use.

BACKGROUND

The recreational vehicle industry in Australia is an integral part of the Australian lifestyle and is also very popular in many other parts of the world, for example, the USA, Europe, and there is even an emerging trend for recreational vehicles in China.

A recreational vehicle is a motor vehicle or trailer equipped with living space and amenities normally found in a home. For example, a recreational vehicle may include a kitchen, bathroom and/or sleeping facilities. Therefore, the term recreational vehicle encompasses motorhomes, campervans, caravans, travel trailers, fifth wheel trailers, toy haulers, popup trailers, slide-in campers and the like.

Recreational vehicles have evolved in their design over the years. In the case of electrical appliances recreational vehicles in Australia are typically wired up with two electrical systems—240V AC (mains electricity) and 12V DC. This is a practical solution in that high current drawing appliances like air conditioners and heaters can use 240V (where it is available) and lower current drawing appliances like modern day televisions operate from 12V DC which is typically utilised in recreational vehicles as this is the voltage that the vehicle (and/or tow vehicle) generally operates on.

It is the expectation from most consumers that modern recreational vehicles will be fitted with a quality audio and visual system—which may include a television (with satellite/cable/Pay TV capability), audio system with radio and CD capability and the like.

The internal speakers in a recreational vehicle are typically fitted in the roof. The roof of a recreational vehicle can become quite crowded as it may include an air conditioner, vent(s), sky-light(s), roof hatch(es), lighting, TV antenna controls etc. Some recreational vehicles (generally the middle to high-end models) are also fitted with speakers on the outside wall of the vehicle (typically the same side as an annex or awning). This allows for the audio system to be utilised when people are outside eating, entertaining etc.—and these external speakers need to be waterproof or at least water resistant.

In order to save space, and/or for aesthetic reasons, it is often desirable to mount light fixtures and speakers within wall or ceiling cavities or recesses. This is typically done by mounting separate light and speaker fixtures. However, these separate mountings require more openings to be cut into a wall or ceiling, often detracting from the aesthetics of the room or environment in which they are mounted, and requiring separate wiring for each. In addition, a critical concern of Original Equipment Manufacturers (OEMs) is that components allow them to manufacture a recreational vehicle quickly and at reduced cost if possible.

Like a house, recreational vehicles are built utilising electrical wiring running through the walls. However, space for wiring is very limited and at a premium in a recreational vehicle, and it is very hard to add to or change the wiring once the recreational vehicle is assembled, This means it is difficult and expensive to add speakers to a recreational vehicle and route speaker wiring back to the audio system.

It is an object of the present invention to substantially overcome or at least ameliorate one or more of the disadvantages of the prior art.

SUMMARY

In a first aspect, the present invention provides a speaker assembly and integrated light, comprising:

a speaker having at least one sound emitting element; and, at least one array of LEDs mounted on the speaker.

In arrangements of the first aspect, the speaker assembly and integrated light may be configured to be mounted on the interior or exterior of a recreational vehicle. The speaker assembly and integrated light may be water resistant, and this is particularly preferred if the speaker assembly is configured to be mounted on the exterior of a recreational vehicle.

In a second aspect, the present invention provides a speaker assembly and integrated light, comprising:

a speaker having at least one sound emitting element; and, at least one array of LEDs mounted on the speaker, wherein the assembly is water resistant, the array of LEDs and the sound emitting element operate independently, and the sound emitting element(s) are wirelessly connected to an audio source.

In arrangements of the second aspect, the speaker and LEDs may have a common power source. The common power source may be 12V DC.

In arrangements of either aspect, the speaker and LEDs may operate independently. The speaker may comprise at least two sound emitting elements including a low frequency sound emitting element and a high frequency sound emitting element, The speaker may comprise four sound emitting elements including two low frequency sound emitting elements and two high frequency sound emitting elements. One or more high frequency sound emitting elements may be a bridge mounted tweeter.

Further, at least one array of LEDs may be substantially disposed in a circle about the speaker. Two arrays of LEDs may be substantially disposed in concentric circles about the speaker. Where the speaker is wirelessly connected to an audio source, the wireless connection may be a Bluetooth connection.

BRIEF DESCRIPTION OF THE DRAWINGS

Preferred embodiments of the invention will now be described with reference to the accompanying drawings wherein.

DESCRIPTION OF EMBODIMENTS

Figure 1A:
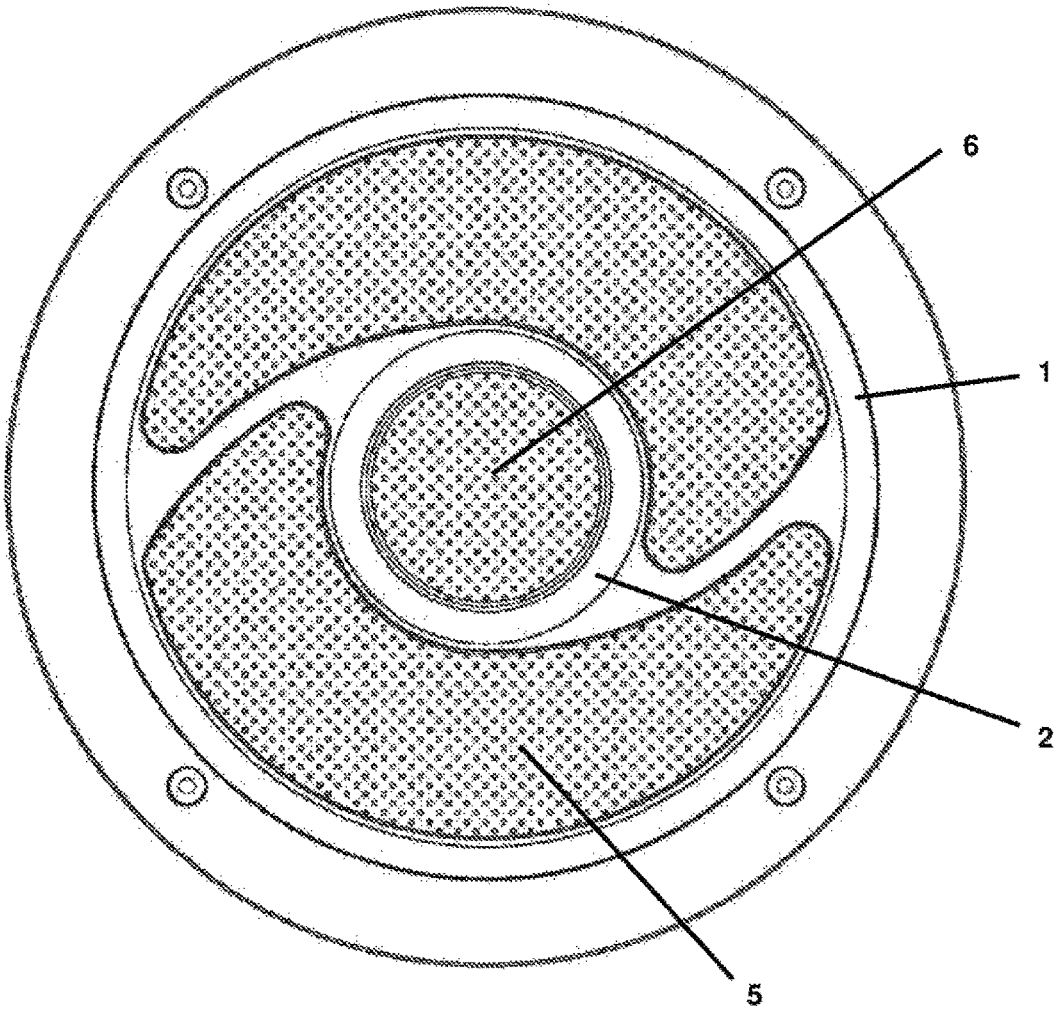
FIG. 1A is a top view line drawing of a speaker cover with integrated LEDs in accordance with an embodiment of the present invention.
Figure 1B:
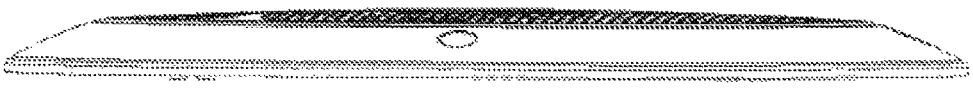
FIG. 1B is a side view line drawing of a speaker cover with integrated LEDs in accordance with an embodiment of the present invention.
Figure 2:
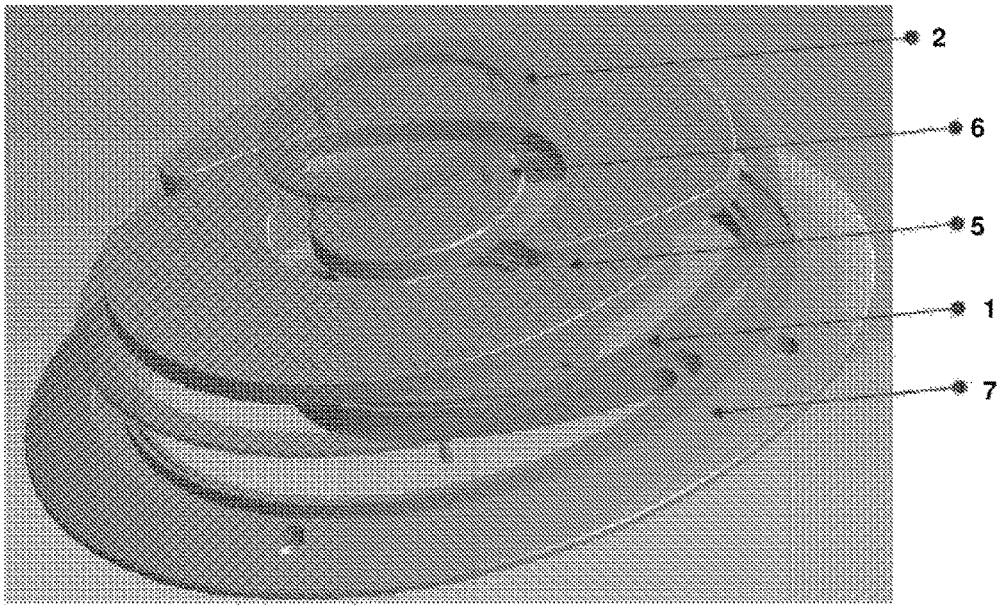
FIG. 2 is an exploded view of a speaker cover and integrated LEDs in accordance with an embodiment of the present invention.

In an embodiment, depicted in FIGS. 1A through 2, the speaker assembly takes the general form of an approximately 6 inch (approx. 15.24 cm) diameter recessed audio speaker with two arrays of LEDs 1 and 2 mounted on the speaker and substantially disposed in concentric circles about the speaker. Speaker assemblies according to this embodiment may be configured to be mounted in the interior of a recreational vehicle with the LEDs thereby providing a combination speaker and interior light.

Figure 3A:
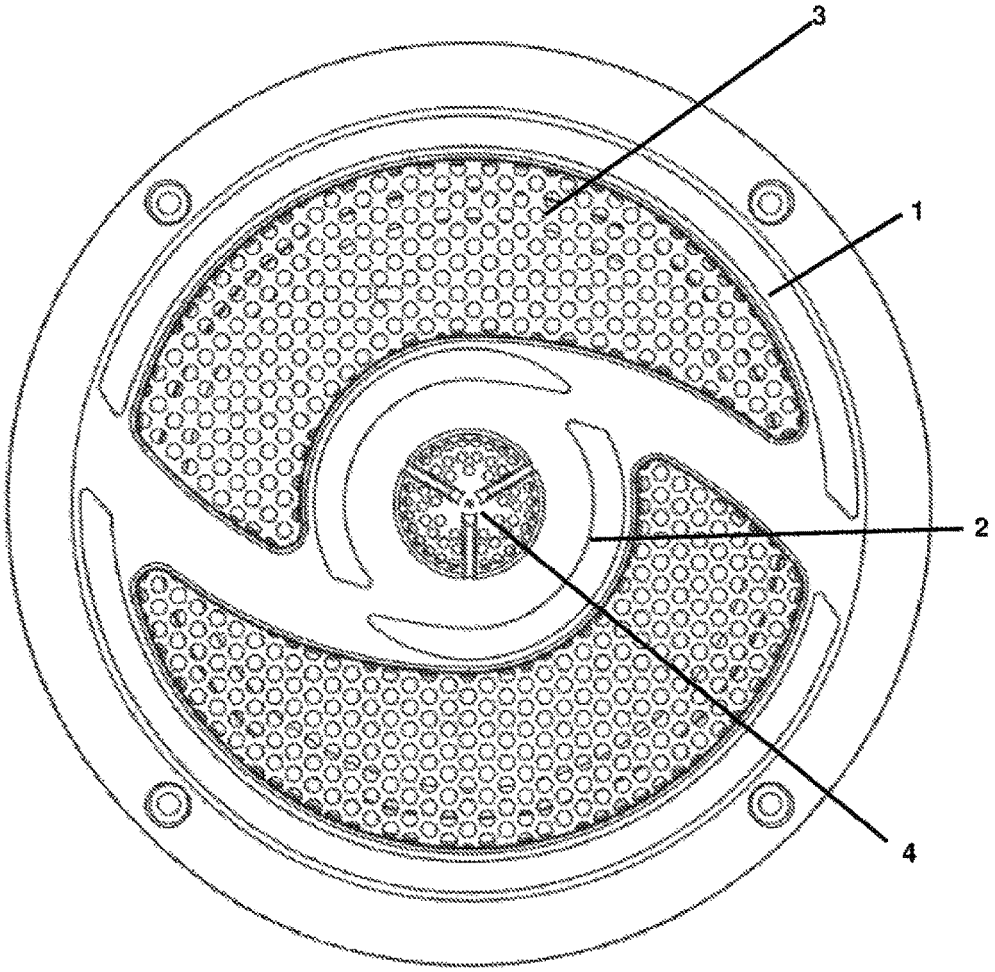
FIG. 3A is a top view line drawing of a speaker assembly in accordance with an alternative embodiment of the present invention.
Figure 3B:
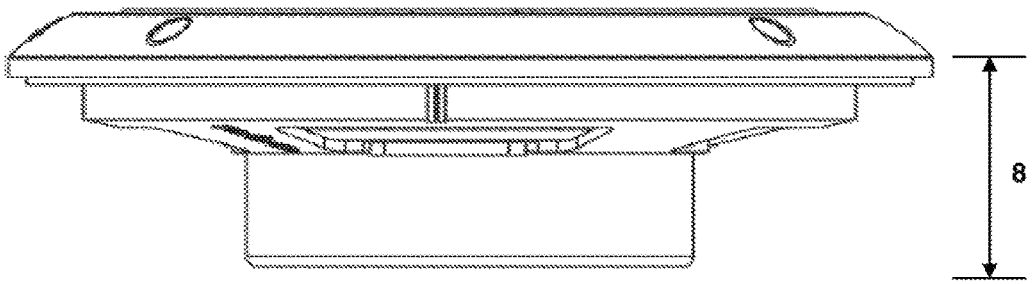
FIG. 3B is a side view line drawing of a speaker assembly in accordance with an alternative embodiment of the present invention.

In an alternative form of the embodiment, depicted in FIGS. 3A and 3B, the speaker assembly again takes the general form of an approximately 6 inch (approx. 15.24 cm) diameter recessed audio speaker with two arrays of LEDs 1 and 2 mounted on the speaker and substantially disposed in concentric circles about the speaker. In this alternative embodiment, the speaker assembly is water resistant and has different cosmetic styling. Further, the two arrays of LEDs 1 and 2, while still being substantially disposed in concentric circles about the speaker, do not form a continuous circle of light.

Speaker assemblies in accordance with this alternative form of the embodiment may be mounted in the interior of a recreational vehicle and are preferred in wet areas such as, for example, kitchen and bathroom areas. Speaker assemblies in accordance with this alternative embodiment may also be configured to be mounted on the exterior of a recreational vehicle.

By integrating a light into a speaker assembly, time and cost may be saved in the manufacturing process of an RV as less holes need to be cut in the interior and less items mounted, but also space is saved in the roof as well as less wiring is required. From a cosmetic perspective, it may also offer a stylish alternative to what can be a bland item (that is, a speaker that is primarily designed for the car environment).

Further, when the assembly is configured to replace a speaker or light in a recreational vehicle it may fit into a standard sized speaker hole. This allows such an assembly to be used as an upgrade to existing recreational vehicles. Such an assembly may also be easily included by OEMs as the roof layout and/or manufacturing jigs do not need to be altered. Mounting depth (indicated as 8 in FIG. 3B) is also relevant as a recreational vehicle speaker ideally should have a maximum depth of not more than about 40 mm deep and the inclusion of the LEDs in accordance with the present invention need not appreciably increase the protrusion of the speaker externally from a cosmetic point of view.

The inclusion of LEDs is also advantageous as LEDs typically operate at a lower voltage relative to incandescent, fluorescent, neon and halogen lights. LEDs are typically more efficient than most other forms of lighting, and typically need to be replaced less often.

As indicated in FIG. 3A, the speaker assembly comprises two sound emitting elements including a low frequency sound emitting element 3 and a high frequency sound emitting element 4 positioned above it. A low frequency sound emitting element (sometimes referred to as a 'woofer') in accordance with the present invention may produce sound from about 20 Hz to about 2 KHz. A high frequency sound emitting element (sometimes referred to as a 'tweeter') in accordance with the present invention may produce sound from about 800 Hz to about 20 KHz. The high frequency sound emitting elements are typically directional. The high frequency sound emitting element 4 depicted in FIG. 3A is a bridge mounted tweeter and is surrounded by the inner concentric circle of LEDs 2.

As depicted in FIGS. 1A and 2, a speaker assembly comprising a low frequency sound emitting element and a high frequency sound emitting element positioned above it may each have a corresponding (woofer) grill 5 and (tweeter) grill 6. In FIG. 2, the grills 5 and 6 and concentric LED arrays 1 and 2 are accommodated by a gasket 7.

Figure 4A:
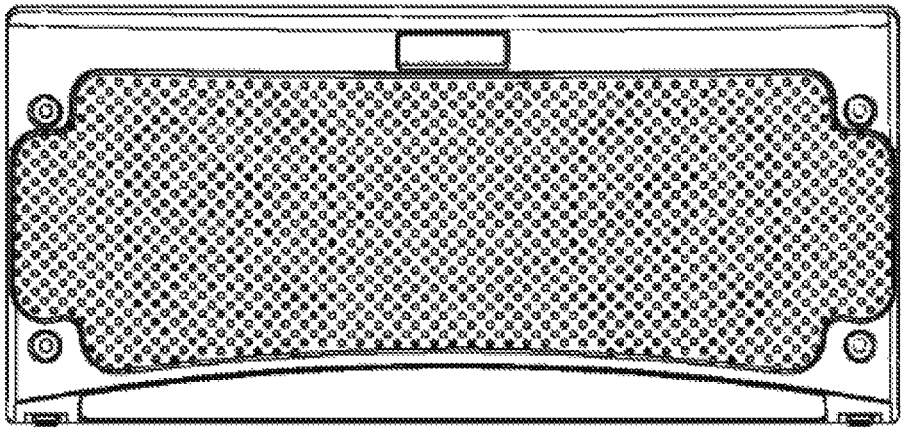
FIG. 4A is a top view line drawing of a speaker assembly in accordance with a further alternative embodiment of the present invention.
Figure 4B:
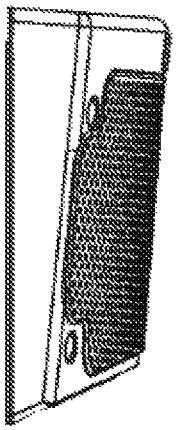
FIG. 4B is a side view line drawing of a speaker assembly in accordance with a further alternative embodiment of the present invention.
Figure 4C:
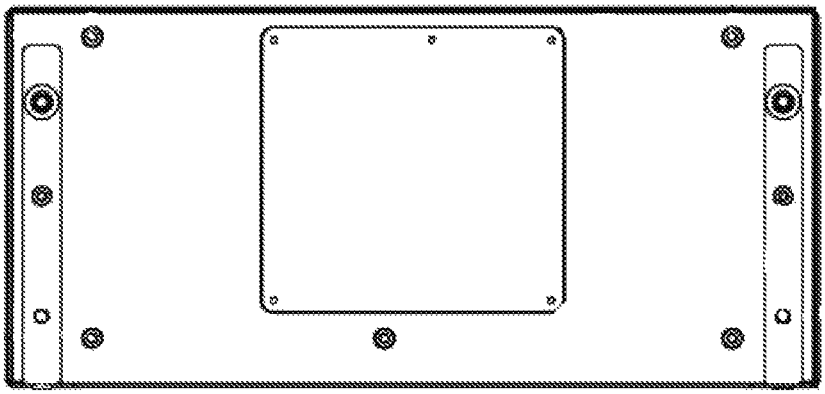
FIG. 4C is a back view line drawing of a speaker assembly in accordance with a further alternative embodiment of the present invention.

In a further alternative embodiment, depicted in FIGS. 4A through 4C. the speaker assembly and integrated light takes the general form of a water resistant awning light for mounting onto the exterior of a recreational vehicle.

The curved design (best seen in FIG. 4B) ensures the speaker has minimal wind drag when the recreational vehicle is moving. The speaker comprises four sound emitting elements, two low frequency sound emitting elements and two high frequency sound emitting elements. The high frequency sound emitting elements are is bridge mounted tweeters. The sound emitting elements, particularly, the high frequency sound emitting elements are angled downwards to ensure the sound is directed to the listeners below (when the recreational vehicle is stationary). The light may also be angled to maximise the light coverage on the ground below the recreational vehicle.

In this embodiment, the speaker and LEDs may use the power source intended for the awning light as a common power source.

In arrangements of each embodiment detailed above and the present invention generally, the power source is preferably 12V DC. The power source may alternatively be about 8V DC, about 10V DC, about 100V AC, about 110V AC, about 120V AC, about 230V AC or about 240V AC. Where the power source is derived from AC it may be converted to DC in order to power an assembly. The power source may be mains electricity. The power source may be a battery, The power source may be derived from solar energy. In other embodiments, the assembly may comprise one or more batteries, such batter(ies) may be the sole power source or a back-up power source. Where the power source includes a battery, the battery may be rechargeable. The battery may be rechargeable by a USB (Universal Serial Bus) connection.

A wireless connection in relation to a speaker in accordance with the present invention means that an audio signal is sent from an audio source, for example, a portable stereo or smart phone, wirelessly to the sound emitting element. Such a wireless connection may be a Bluetooth connection. The speaker, however, may need a wire as it needs to be connected to a power source, or be rechargeable from a power source. Bluetooth is a wireless technology standard for exchanging data over short distances (using short-wavelength UHF radio waves in the ISM band from 2.4 to 2.485 GHz). Bluetooth is managed by the Bluetooth Special Interest Group.

Preferably a water resistant awning light for mounting onto the exterior of a recreational vehicle in accordance with an embodiment of the invention comprises a power lead fitted with male and female line plugs which may allow the speaker to be pre-wired and easily connected by joining the two plugs together. The power plug may allows for the connection of an optional 240V plug pack and allow the awning light to be temporarily mounted if required. If installing in place of an exterior in awning light, the following steps may be followed:

1. Remove the existing awning light.
2. Mark the location of the mounting screws (typically four (4)). Be careful to ensure the screws will not damage any materials behind the mounting surface.
3. Connect the power plug to the socket.
4. Mount the speaker using the screws—taking care not to over tighten the screws. The power wire should be recessed as much as possible in its hole where supplied from and any excess cable stored in the cavity at the back of the awning light.
5. Press in any supplied screw covers to hide the screws for aesthetics.
6. Using a suitable recreational vehicle sealant, seal around the edge of the awning light ensuring a water-tight seal to complete the installation.

To ensure easy operation, where the speaker assembly and integrated light is fitted in place of an awning light, the recreational vehicle awning light power switch may be employed to control the power source. The assembly may be fitted with an LED on/off switch on the assembly allowing the LEDs to be turned on or off as required.

A wireless connection to a speaker in accordance with an embodiment may be established by use of a portable digital device, such as, for example, a tablet or smartphone, using Bluetooth A2DP Audio Streaming technology. The following steps may be followed:

1. When powered on, an additional red LED on the assembly may indicate that the power source is switched on.
2. Within a short time period, for example, three (3) seconds, an additional blue LED on the assembly may indicate that the Bluetooth receiver is working.
3. If not connected to a Bluetooth transmitter such as a smartphone or other Bluetooth transmitting device, the unit may switch to a "discovery" mode waiting for a Bluetooth connection which may be indicated by the blue LED flashing on and off.
4. To connect to the speaker, a menu may be opened on the Bluetooth transmitting device and search for new devices. The assembly should be displayed as an available device and selected to initiate connection. A PIN code may not be required to connect a device to the speaker.
5. The blue LED may be on (not flashing) to indicate the connection is in progress and if successful, it may flash off after a defined time period, for example, every five (5) seconds, confirming the device is connected.
6. Only one (1) device may be connected at a time. However, up to eight (8) devices, once paired, may be stored in memory. This means that a device previously paired may automatically pair once the speaker is turned on providing the device is within range. If, for example, a ninth device is paired with the speaker, the oldest device may be erased and would then need to be manually re-connected if used again.
7. Once the connection is established, the audio controls of the Bluetooth transmitting device may be employed to start audio playback and control the speaker's volume level.
8. Audio may also be streamed from, for example, a smartphone application, including, again for example, radio stations via the internet, video players etc. This feature is likely to be dependent on the particular application(s) and Bluetooth transmitting device capabilities, software and operation system version.

Although preferred forms of the present invention have been described with particular reference to applications in relation to recreational vehicles, it will be apparent to persons skilled in the art that modifications can be made to the preferred embodiments described above or that the invention can be embodied in other forms and used in alternative applications. For example, applications of water resistant embodiments of the present invention are, in particular, not limited to recreational vehicles. Water resistant embodiments of the present invention may be suitable for general outdoor use, such as, for example, in outdoor entertaining areas, outdoor BBQ/camp kitchen areas, pergolas and/or pool environments.

Throughout this specification and the claims which follow, unless the context requires otherwise, the word "comprise", and variations such as "comprises" and "comprising", will be understood to imply the inclusion of a stated integer or in step or group of integers or steps, but not the exclusion of any other integer or step or group of integers or steps.

The reference in this specification to any prior publication (or information derived from it), or to any matter which is known is not, and should not be taken as an acknowledgment or admission or any form of suggestion that that prior publication (or information derived from it) or known matter forms part of the common general knowledge in the field of endeavour to which this specification relates.

The invention claimed is:

1. A speaker assembly and integrated light for lighting a recreational vehicle, comprising:

a speaker having at least one sound emitting element; and, at least one array of LEDs mounted on the speaker for lighting an area associated with the recreational vehicle, wherein the at least one array of LEDs and the at least one sound emitting element operate independently, and the at least one sound emitting element is wirelessly connected to an audio source, and wherein the assembly is configured to be mounted on the exterior of the recreational vehicle.

2. The speaker assembly and integrated light according to claim 1, wherein the speaker comprises at least two sound emitting elements including a low frequency sound emitting element and a high frequency sound emitting element.

3. The speaker assembly and integrated light according to claim 2, wherein at least one high frequency sound emitting element is a bridge mounted tweeter.

4. The speaker assembly and integrated light according to claim 1, comprising at least one array of LEDs substantially disposed in a circle about the speaker.

5. The speaker assembly and integrated light according to claim 4, comprising at least two arrays of LEDs substantially disposed in concentric circles about the speaker.

6. The speaker assembly and integrated light according to claim 1, wherein the assembly is water resistant.

7. The speaker assembly and integrated light according to claim 1, wherein the assembly is configured to be mounted in the interior of the recreational vehicle.

8. The speaker assembly and integrated light according to claim 1, wherein the speaker and LEDs have a common power source.

9. The speaker assembly and integrated light according to claim 8, wherein the common power source is 12V DC.

10. The speaker assembly and integrated light according to claim 1, wherein the wireless connection is a Bluetooth connection.

11. A speaker assembly and integrated light for lighting a recreational vehicle, comprising:

a speaker having at least one sound emitting element; and, at least one array of LEDs mounted on the speaker for lighting an area associated with the recreational vehicle, wherein the at least one array of LEDs and the at least one sound emitting element operate independently, and the at least one sound emitting element is wirelessly connected to an audio source, and wherein there are at least four sound emitting elements including two low frequency sound emitting elements and two high frequency sound emitting elements.

12. The speaker assembly and integrated light according to claim 11, wherein at least one high frequency sound emitting element is a bridge mounted tweeter.

13. The speaker assembly and integrated light according to claim 11, comprising at least one array of LEDs substantially disposed in a circle about the speaker.

14. The speaker assembly and integrated light according to claim 13, comprising at least two arrays of LEDs substantially disposed in concentric circles about the speaker.

15. The speaker assembly and integrated light according to claim 11, wherein the assembly is water resistant.

16. The speaker assembly and integrated light according to claim 11, wherein the assembly is configured to be mounted in the interior of the recreational vehicle.

17. The speaker assembly and integrated light according to claim 11, wherein the speaker and LEDs have a common power source.

18. The speaker assembly and integrated light according to claim 17, wherein the common power source is 12V DC.

19. The speaker assembly and integrated light according to claim 11, wherein the wireless connection is a Bluetooth connection.

* * * * *